US012422223B1

(12) United States Patent
Hiligh

(10) Patent No.: US 12,422,223 B1
(45) Date of Patent: Sep. 23, 2025

(54) GUIDANCE ATTACHMENT FOR FIREARM

(71) Applicant: Wilbur Hiligh, Fort Washington, MD (US)

(72) Inventor: Wilbur Hiligh, Fort Washington, MD (US)

( * ) Notice: Subject to any disclaimer, the term of this patent is extended or adjusted under 35 U.S.C. 154(b) by 27 days.

(21) Appl. No.: 18/610,358

(22) Filed: Mar. 20, 2024

(51) Int. Cl.
*F41G 3/16* (2006.01)

(52) U.S. Cl.
CPC ..... *F41G 3/165* (2013.01)

(58) Field of Classification Search
CPC ..... F41G 3/165
USPC ..... 42/111
See application file for complete search history.

(56) References Cited

U.S. PATENT DOCUMENTS 8,893,701 B1 * 11/2014 Entrup ..... G03B 17/561 124/87
9,325,366 B1 * 4/2016 Zhou ..... H04B 1/3888
11,079,201 B2 * 8/2021 Tustison ..... F16M 11/2092
11,092,409 B1 * 8/2021 Campbell ..... H04M 1/04
11,686,559 B2 * 6/2023 Paranto ..... F41H 13/0043 42/106
2013/0288743 A1 * 10/2013 Hunt ..... F16M 11/2014 29/434
2015/0141100 A1 * 5/2015 Carter ..... A63F 9/0291 463/2
2017/0010073 A1 * 1/2017 Downing ..... F41C 27/00
2020/0084410 A1 * 3/2020 Sakiewicz ..... F41G 1/35
2022/0404121 A1 * 12/2022 Loebig ..... F41G 1/30
2023/0142324 A1 * 5/2023 Campbell ..... F41G 11/003 42/113
2025/0123076 A1 * 4/2025 Campbell ..... F41G 1/545

* cited by examiner

*Primary Examiner* — Samir Abdosh
(74) *Attorney, Agent, or Firm* — Robert Goozner

(57) ABSTRACT

A guidance system for a firearm includes a snap-on optical attachment and a flexible touch screen. The guidance system includes at least one camera; a high-definition flexible touch screen; a cable connecting the camera to the touch screen; a 3 point 5 point hinge connected to the touch screen; a battery; and a processor. A thermal sensor or thermal or infrared camera may also be included. The guidance system is water resistant for up to 30 minutes.

20 Claims, 9 Drawing Sheets

GUIDANCE ATTACHMENT FOR FIREARM

FIELD OF DISCLOSURE

The disclosure pertains to a guidance system for a firearm that includes a camera and an adjustable touch screen.

BACKGROUND

A sight for a firearm any device used to assist in precise visual alignment (i.e. aiming) of ranged weapons with the intended target. Sights can be a simple set or system of physical markers that serve as visual references for directly aligning the user's line of sight with the target that provide an optically enhanced—often magnified—target image aligned in the same focus with an aiming point (e.g. telescopic, reflector and holographic sights).

A sight typically has two components, front and rear aiming pieces that must be lined up. Sights such as this can be found on many types of devices including weapons, surveying and measuring instruments, and navigational tools.

On weapons, these sights are usually formed by rugged metal parts, giving them the name "iron sights", as distinct from optical or computing sights. On many types of weapons they are built-in and may be fixed, adjustable, or marked for elevation, windage, target speed, etc. They are also classified in forms of notch (open sight) or aperture (closed sight). These types of sights can require considerable experience and skill, as the user has to hold proper eye position and simultaneously focus on the rear sight, the front sight, and a target, all at different distances, and align all three planes of focus.

However, recent developments in computer, camera and AI technology, along with the increasing requirement for law enforcement personnel to carry cameras and recording equipment, render firearm sights of the conventional art not up to the current requirements of modern law enforcement and combat. Moreover, modern law enforcement and other shooting situations require increasingly more accurate aiming and decision-making.

There is thus a need for smarter and more accurate firearm sights.

The Background section of this document is provided to place embodiments of the present disclosure in technological and operational context, to assist those of skill in the art in understanding their scope and utility. Unless explicitly identified as such, no statement herein is admitted to be prior arts merely by its inclusion in the Background section.

SUMMARY

The following presents a simplified summary of the disclosure in order to provide a basic understanding to those of skill in the art. This summary is not an extensive overview of the disclosure and is not intended to identify key/critical elements of embodiments of the disclosure or to delineate the scope of the disclosure. The sole purpose of this summary is to present some concepts disclosed herein in a simplified form as a prelude to the more detailed description that is presented later.

The disclosure, in part, pertains to a guidance system for a firearm, that includes at least one camera; a high-definition flexible touch screen; a cable connecting the camera to the touch screen; a 3 point 5 point hinge connected to the touch screen; a battery; and a processor. The camera may include a night vision sensor and a thermal sensor. The guidance system may be mounted on a fixture configured to snap onto the firearm and not make contact with the receiver of the firearm. the guidance system is mounted on a fixture configured to snap onto the firearm, and the frame is formed from carbon fiber or plastic.

In the guidance system of the disclosure, the flexible touch screen may be rotatable. The battery may be a 4000 mah battery pack, and the battery may be rechargeable.

In the guidance system of the disclosure, the screen may have a tinted screen cover. The camera may be configured to mount on a side of the firearm. The touch screen may be 3 inches by 5 inches square. The touch screen may have a zooming capacity. The guidance system may include a thermal camera, and the thermal camera may have a 200× zoom capability. The guidance system may be water resistant in fresh water to a maximum depth of 1.5 meters for up to 30 minutes. The processor may be configured to integrate data from the camera and a thermal sensor or a thermal camera and to project the integrated data onto the touch screen.

In an embodiment, there is a male electrical connector directly attached to the touch screen, and the male electrical connector is configured to be attached to a female electrical connector. Alternately, wherein there is a male electrical connector attached to the touch screen, and a gooseneck having a male electrical connector and a female electrical connector configured to be attached to the male electrical connector attached to the touch screen. The gooseneck can be a solid tube with an electrical cable running inside. The gooseneck may also be a flexible coaxial cable.

BRIEF DESCRIPTION OF THE DRAWINGS

The present disclosure will now be described more fully hereinafter with reference to the accompanying drawings, in which embodiments of the disclosure are shown. However, this disclosure should not be construed as limited to the embodiments set forth herein. Rather, these embodiments are provided so that this disclosure will be thorough and complete, and will fully convey the scope of the disclosure to those skilled in the art. Like numbers refer to like elements throughout.

DETAILED DESCRIPTION

For simplicity and illustrative purposes, the present disclosure is described by referring mainly to exemplary embodiments thereof. In the following description, numerous specific details are set forth in order to provide a thorough understanding of the present disclosure. However, it will be readily apparent to one of ordinary skill in the art that the present disclosure may be practiced without limitation to these specific details.

The disclosure addresses the disadvantages of sighting devices of the conventional art. The solution, in part, is snap on gun attachments with flexible touchscreen with zooming functionality.

The disclosure pertains to a guidance system that is a viper vision optical attachment for a firearm. Features of the disclosure may include a detachable 5 position 3"×5" (diagonal=5.8") hinged flexible touch screen with zoom functionality. The touch screen can be larger than 3"×5", for example diagonals of 7", 8", 9" or 10". The touch screen can be 4 W resistive, 5 W resistive or capacitive. The input to the touch screen can be HDMI, USB-C, SDI, VGA, DVI or composite. The attachment can have thermal vision, night vision, and a camera. Power may be supplied by a removable battery that may be a 2500 mah lithium battery. The attachment can have an aluminum charging handle, rifle mount integration or a molded 3D printed snap on arrangement. There can be 200× zoom for small arms and light weapons, and an ip68 rating. Tactical link software can be through Hotspot.

Figure 1:
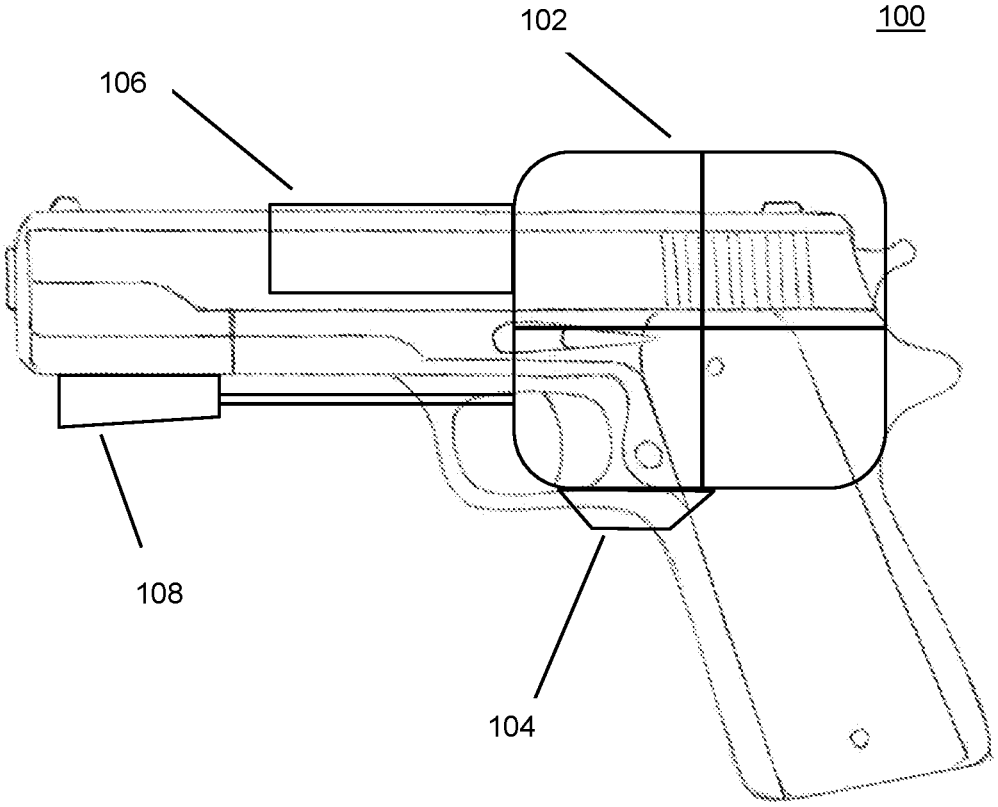
FIG. 1 is a diagram of a side view of pistol on which is mounted the guidance system in accordance with and embodiment of the disclosure.

FIG. 1 is a diagram of the guidance system mounted on a pistol. In the side view of FIG. 1, the guidance system 100 includes a flexible touch screen 102 which can be adjusted to different positions with a 3-point or 5-point adjustable hinge 104. The touch screen is mounted on a housing 106 that can be made from carbon fiber, aluminum, steel or a plastic such as high density polyethylene (HDPE), high density polypropylene (HDPP), polyvinyl chloride (PVC), polycarbonate, etc. The guidance system may include a sensor element 108 that can include a camera, night vision camera, thermal sensor and a laser pointer. The touch screen has a zoom function that can magnify up to 200×.

The night vision camera (NVC) is an optoelectronic device that allows visualization of images in low levels of light, improving the user's night vision. The device enhances ambient visible light and converts near-infrared light into visible light which can be seen by the user; this is known as $I^2$ (image intensification). By comparison, viewing of infrared thermal radiation is referred to as thermal imaging and operates in a different section of the infrared spectrum. The night vision camera usually includes an image intensifier tube and a protective housing. Many NVCs also include a protective sacrificial lens, mounted over the front lens (i.e., objective lens) on NVCs to protect the latter from damage by environmental hazards, and some can incorporate telescopic lenses. The image produced by an NVC is typically monochrome green, as green was the easiest color to look at for prolonged periods in the dark. Night vision devices may be passive, relying solely on ambient light, or may be active, using an IR (infrared) illuminator to visualize the environment better. Some or all of these elements may be incorporated into the sensor element.

The thermal sensor can be a thermally sensitive resistor (thermistor) whose prime function is to exhibit a large, predictable and precise change in electrical resistance when subjected to a corresponding change in body temperature. Negative Temperature Coefficient (NTC) thermistors exhibit a decrease in electrical resistance when subjected to an increase in body temperature and Positive Temperature Coefficient (PTC) thermistors exhibit an increase in electrical resistance when subjected to an increase in body temperature.

Figure 2:
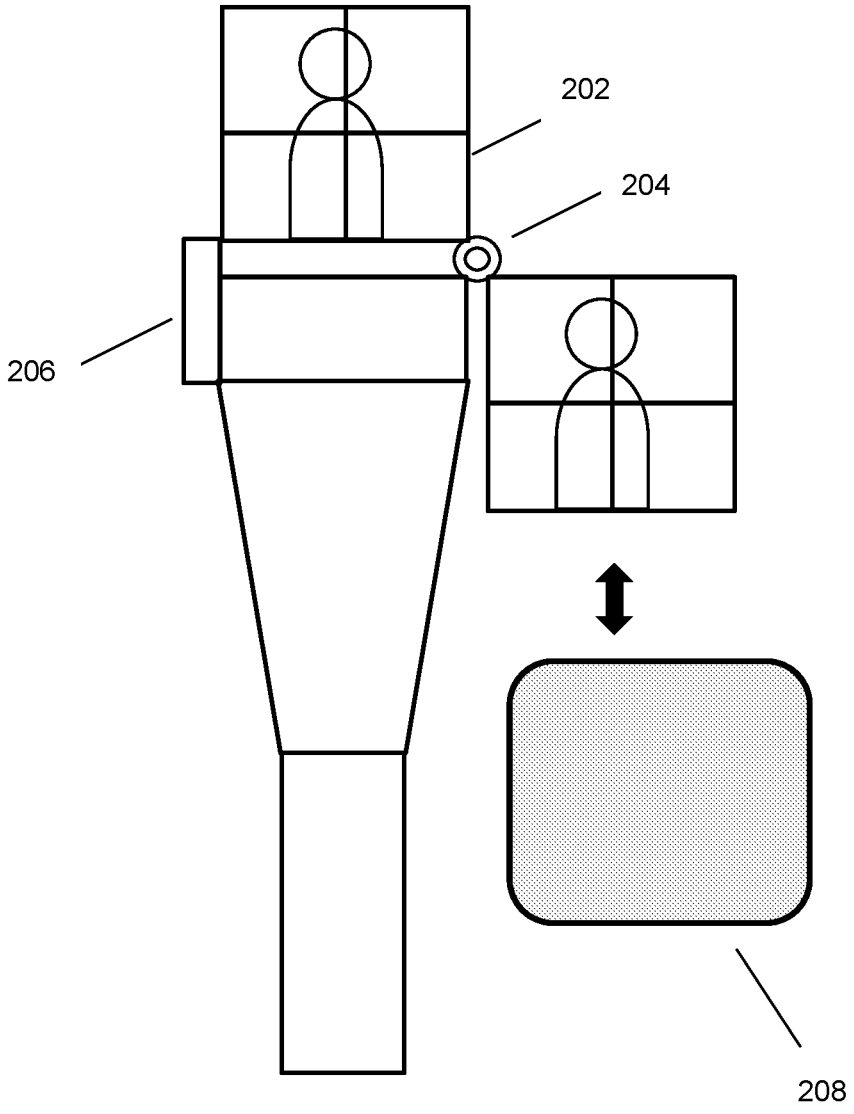
FIG. 2 is a diagram of a back view of pistol on which is mounted the guidance system in accordance with and embodiment of the disclosure.

FIG. 2 is a rear view of a pistol on which the guidance system of the disclosure is mounted. The guidance system includes a snap-on attachment 202 that includes a hinge 204 (corresponding to hinge 104) that can rotate or adjust the touch screen. A rechargeable battery 206 is mounted on the housing. The hinge can be formed from steel or aluminum. Alternately, the hinge may be formed from a plastic such as an acrylic, a methacrylic or a polyamide. A tinted cover 208 is configured to cover the screen. The cover may be formed from a plastic such as acrylic polymer or methacrylic polymer.

Figure 3:
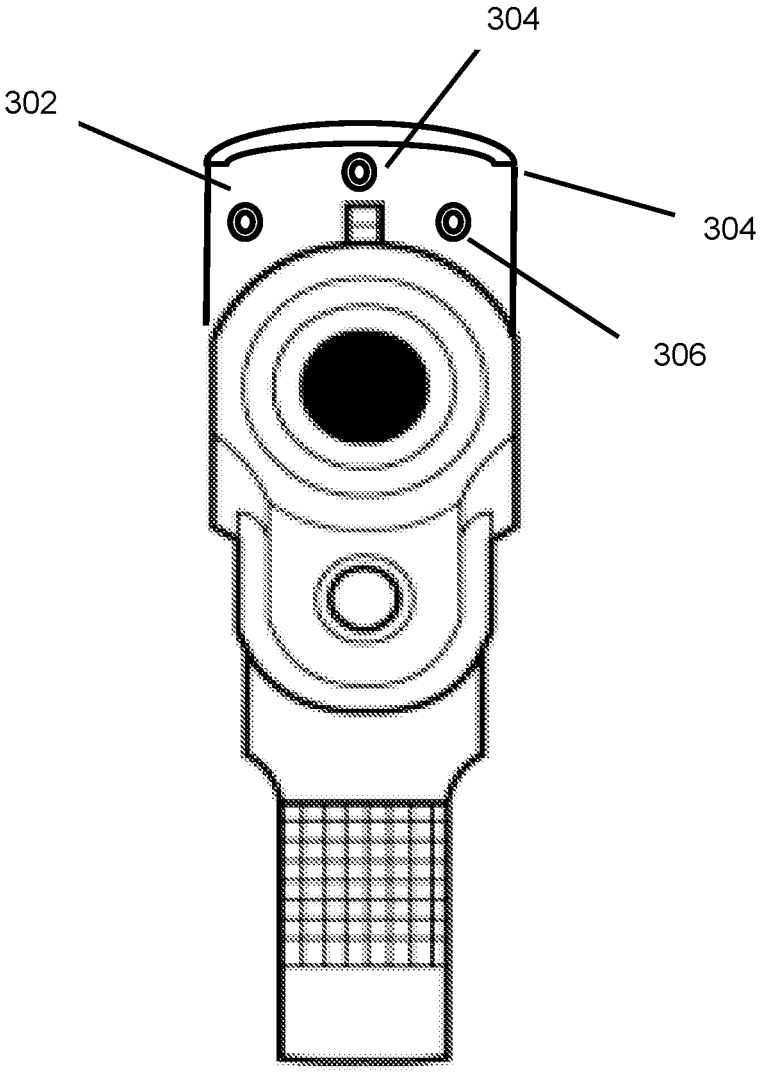
FIG. 3 is a diagram of a front view of pistol on which is mounted the guidance system in accordance with and embodiment of the disclosure.

FIG. 3 is a frontal view of the guidance system of the disclosure mounted on the front of a pistol. The front view includes a night vision sensor 302, a camera 304 and a thermal sensor (thermistor) or thermal camera 306 mounted on the front of housing 308, which can be made of carbon fiber. The guidance system can also include a laser sight in conjunction with the camera.

Figure 4:
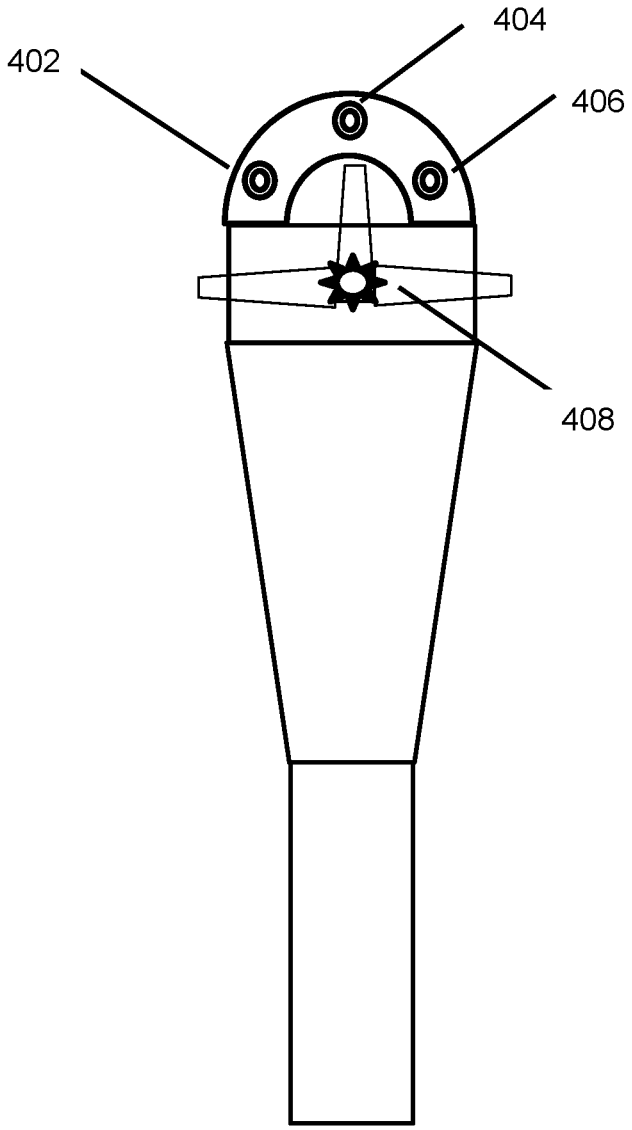
FIG. 4 is a diagram of a 3 position gear and a camera position in accordance with and embodiment of the disclosure.

FIG. 4 is a distal view of elements of the guidance system of the disclosure. The elements include a thermal sensor position 402, a cameral position 404 and a night vision position 406. A 3-position or 5-position gear 408 is configured to rotate the screen. The gear may be formed from metal or plastic.

Figure 5:
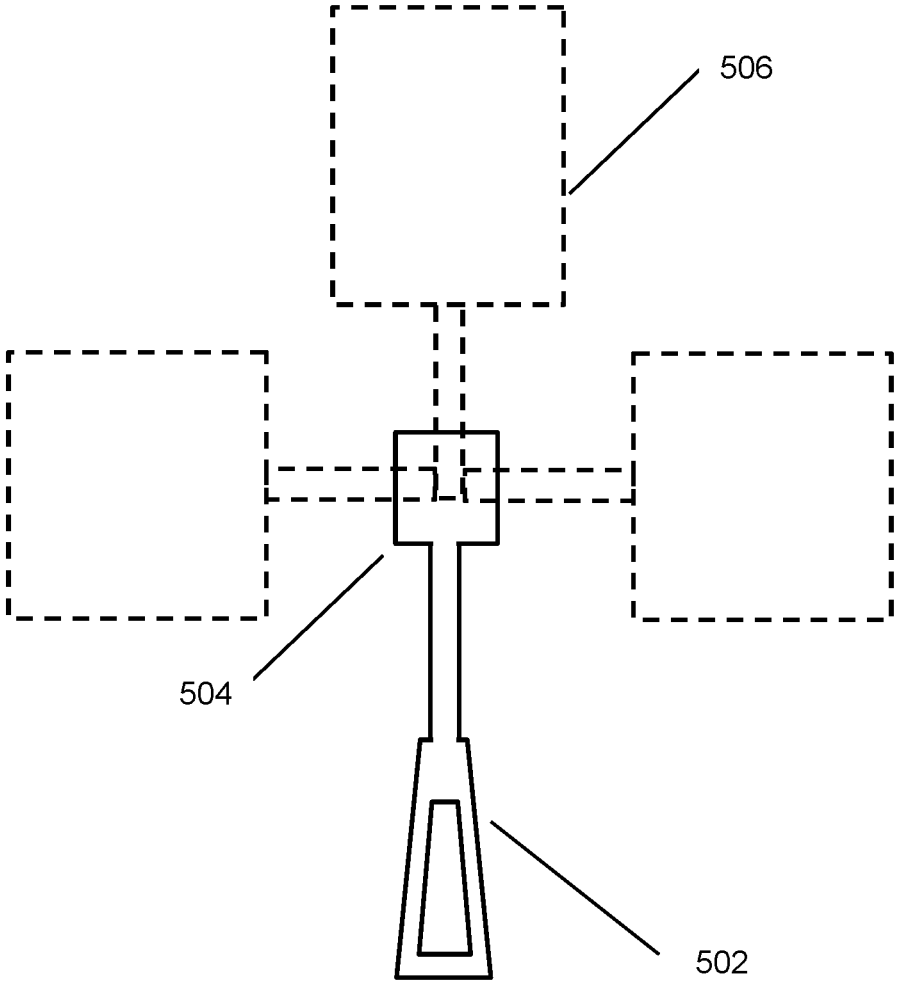
FIG. 5 is a diagram of a 3 position charging handle in accordance with and embodiment of the disclosure.

FIG. 5 is a view of a 3-position charging handle 502 that connects to a slide cover plate 504 to which is attached the screen 506, showing 3 possible orientations. These orientations may include directly over the firearm, to the left side of the firearm, and to the right side of the firearm, as well as any interstitial positions.

Figure 6:
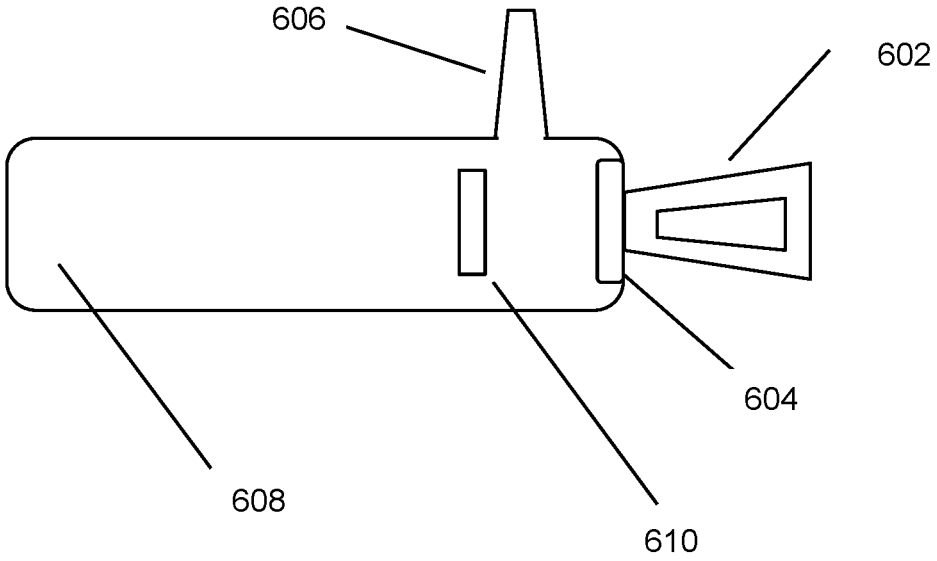
FIG. 6 is side view of the charging handle and side plate in accordance with and embodiment of the disclosure.
Figure 6A:
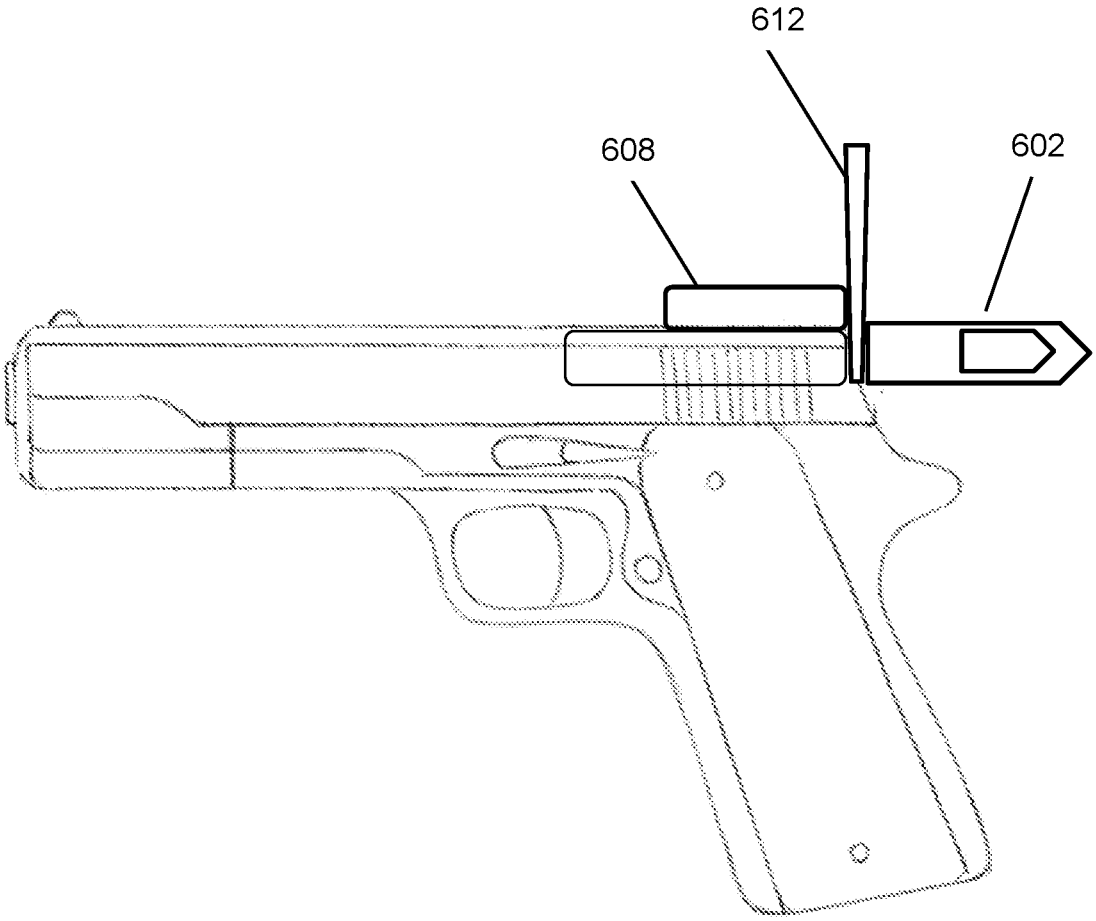
FIG. 6A shows the guidance system and screen mounted on a pistol in accordance with and embodiment of the disclosure.

FIG. 6 is a side view of aspects of the guidance system of the disclosure. This view includes a charging handle 602, a rotating gear 604, camera and sensors 606, and a removable battery 608. A slide cover plate 610 is configured to mount the guidance system on a firearm. FIG. 6A shows the guidance system and screen mounted on a pistol. The charging handle 602 extends from the distal side of the pistol. The battery 608 is mounted over the assembly. In this configuration the screen projects upward.

Figure 7:
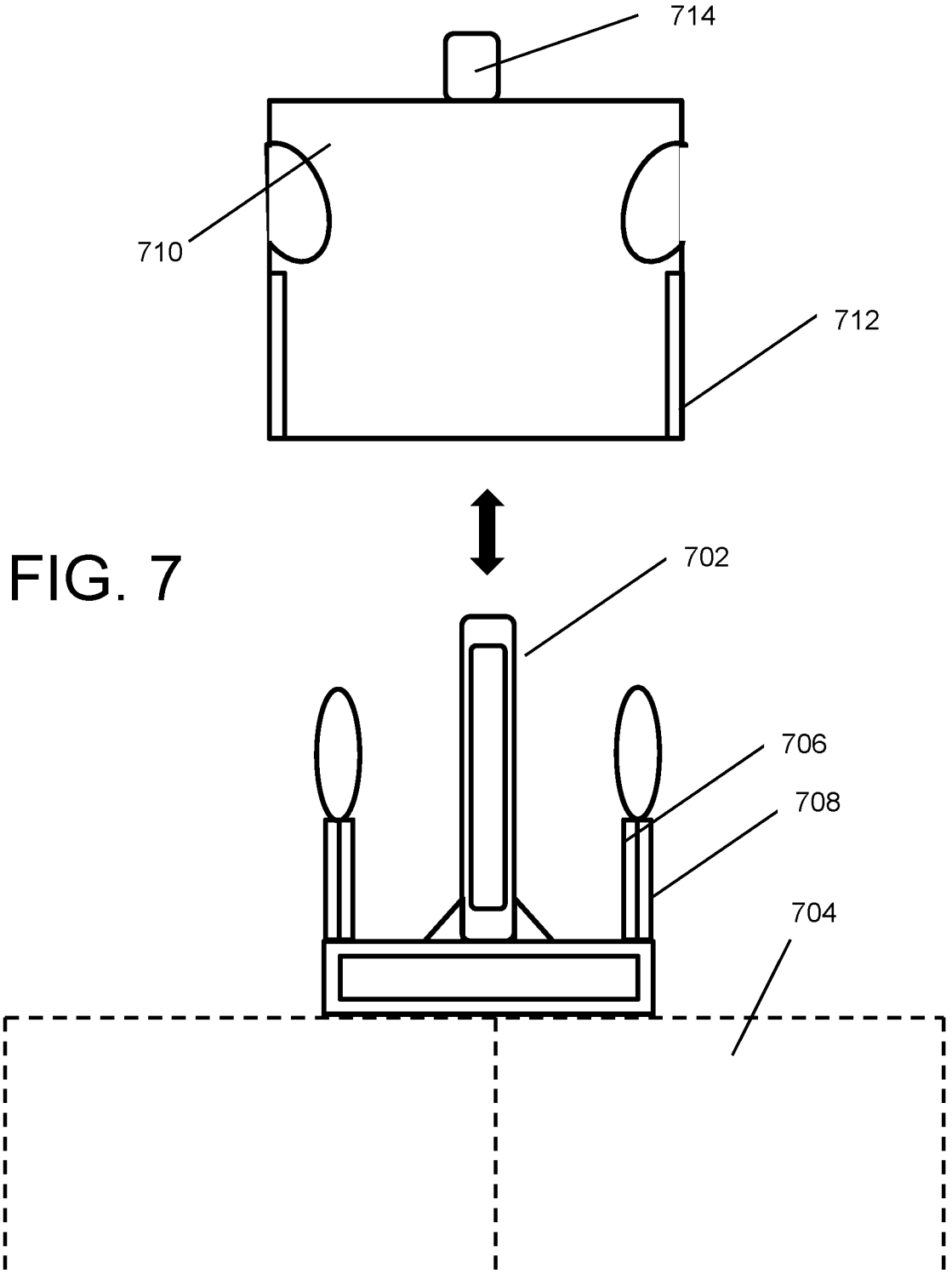
FIG. 7 is a view of a 2-prong screen connector in accordance with and embodiment of the disclosure.

In the disclosure the screen connects to the guidance system. FIG. 7 is a view of a 2-prong male connector 702 connected to the screen. 704. Each prong of the male connector includes a support element 706 and an electrical element 708. The male connector connects with the female connector 710, which also includes an electrically conductive element 712 that corresponds to the electrical elements of the male connector. The female connector also has a rotating ratchet gear connection point 714. The male and female connectors should form a waterproof connection. The system may be used in a harsh environment. The connectors can conform to military specifications such as MIL-DTL-38999, MIL-DTL-26482, MIL-DTL-5015, and MIL-DTL-26500

Figure 7A:
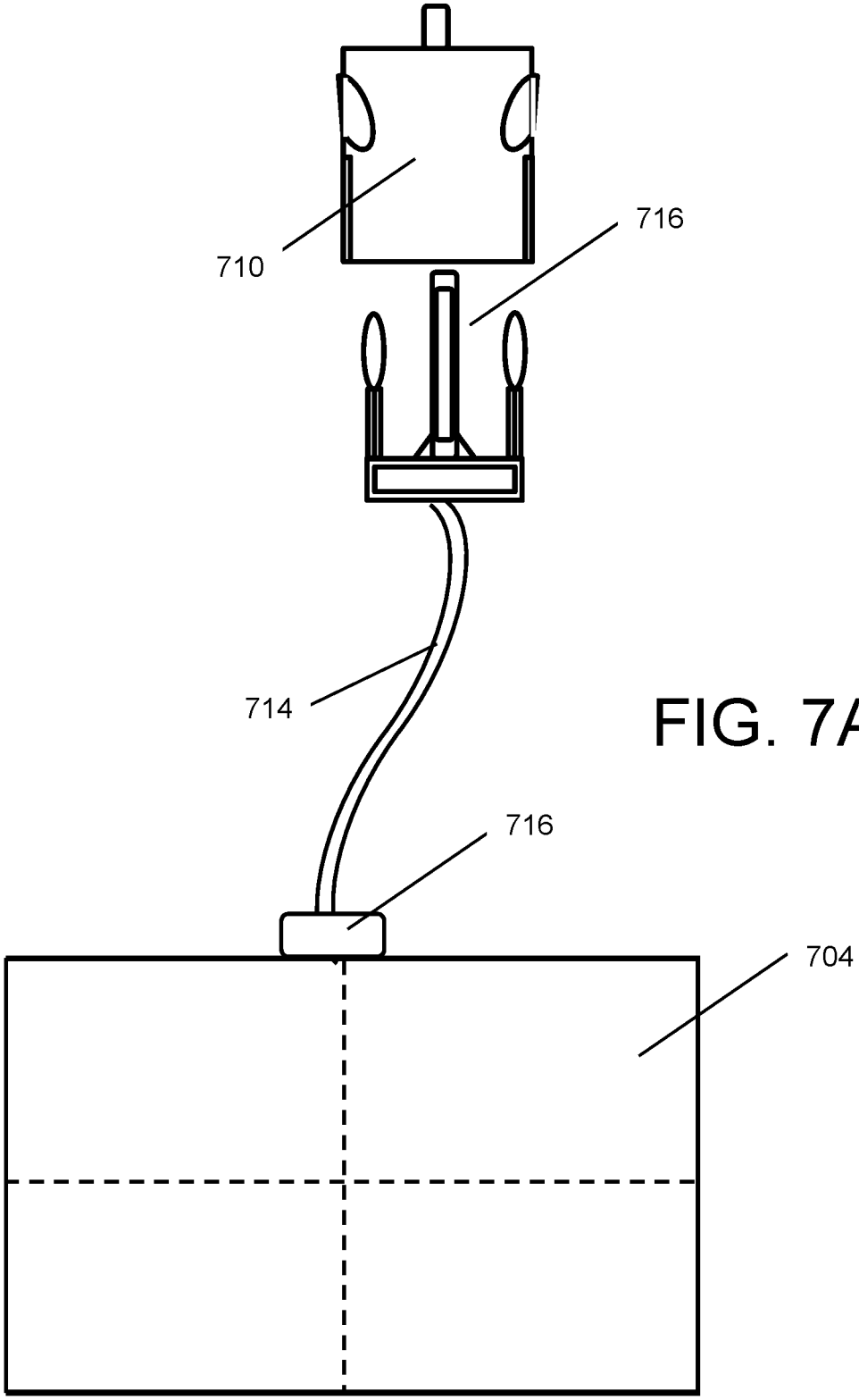
FIG. 7A shows a configuration where the male connector is attached to the screen by a gooseneck in accordance with and embodiment of the disclosure.

FIG. 7A shows a configuration where the male connector 702 is attached to the screen 704 by a gooseneck 714. The gooseneck can be a rigid tube with an electrical cable inside. In an embodiment the gooseneck can be the electrical cable. The electrical cable gooseneck can be a coaxial cable having an inner conductor, a dielectric insulator, a metallic shield and a plastic or rubber jacket. The gooseneck can have one male power connection and 1 female connection so that only 1 touchscreen is needed and can be attached with or without the gooseneck attachment. In this configuration, the male connector of the screen is joined with a female connector of the gooseneck 716. That is, there is a male electrical connector attached to the touch screen, and a gooseneck having a male electrical connector and a female electrical connector configured to be attached to the male electrical connector attached to the touch screen. Also, the configuration can be reversed where the touchscreen if fitted with a female connector that connects with the male connector of the gooseneck.

The guidance system of the disclosure conforms with the IP68 rating for water resistance. An IP (Ingress Protection) rating is an international standard that shows the level of dust and water resistance of the device. Devices that have been certified to an IP68 rating are built to help you do more, in more places. With an IP68 rating, they are water resistant in fresh water to a maximum depth of 1.5 meters for up to 30 minutes, and are protected from dust-all without the need for extra cases or covers.

The battery of the device can be lithium ion battery, which uses the reversible intercalation of Li+ ions into electronically conducting solids to store energy. In comparison with other commercial rechargeable batteries, Li-ion batteries are characterized by higher specific energy, higher energy density, higher energy efficiency, a longer cycle life, and a longer calendar life. A Li-ion battery suitable for smaller devices like a mobile phone or the guidance system of the disclosure can be a 3.6 V Li-ion battery with a specific energy of 100-265 Wh/kg (0.360-0.954 MJ/kg), an energy density of 250-693 Wh/L (0.90-2.49 MJ/L) and a specific power of 250-340 W/kg. Suitable batteries include or a 3.7 V 4000 mah Li-ion battery or a 3.7 V 2500 mah Li-ion battery.

A camera option for the guidance system of the disclosure is a thermal camera, which may have a 200× zoom. The thermal camera is also called a thermographic camera, infrared camera or thermal imaging camera, thermal camera or thermal imager. A thermal camera infrared (IR) radiation, similar to a normal camera that forms an image using visible light. Instead of the 400-700 nanometer (nm) range of the visible light camera, infrared cameras are sensitive to wavelengths from about 1,000 nm (1 micrometer or μm) to about 14,000 nm (14 μm). The practice of capturing and analyzing the data they provide is called thermography. Images from thermal (infrared) cameras tend to be monochrome because the cameras generally use an image sensor that does not distinguish different wavelengths of infrared radiation. Sometimes these monochromatic images are displayed in pseudo-color, where changes in color are used rather than changes in intensity to display changes in the signal. This technique, called density slicing, is useful because although humans have much greater dynamic range in intensity detection than color overall, the ability to see fine intensity differences in bright areas is fairly limited. Resolution of thermal cameras is considerably lower than that of optical cameras, mostly only 160×120 or 320×240 pixels, although more expensive cameras can achieve a resolution of 1280×1024 pixels.

The processor or controller of the disclosure may be a computer processor for which the data processing logic and control is included on a single integrated circuit (IC), or a small number of ICs. The microprocessor contains the arithmetic, logic, and control circuitry required to perform the functions of a computer's central processing unit (CPU). The IC is capable of interpreting and executing program instructions and performing arithmetic operations.[1] The microprocessor is a multipurpose, clock-driven, register-based, digital integrated circuit that accepts binary data as input, processes it according to instructions stored in its memory, and provides results (also in binary form) as output. Microprocessors contain both combinational logic and sequential digital logic, and operate on numbers and symbols represented in the binary number system. The processor receives and integrates data from the camera, thermal sensor, thermal camera, laser etc., and projects the information onto the touch screen, as well as calculating information as to range and direction. Directional information can be obtained via an electronic compass integrated into the guidance unit.

Throughout the specification and the embodiments, the following terms take at least the meanings explicitly associated herein, unless the context clearly dictates otherwise. Relational terms such as "first" and "second," and the like may be used solely to distinguish one entity or action from another entity or action without necessarily requiring or implying any actual such relationship or order between such entities or actions. The term "or" is intended to mean an inclusive "or" unless specified otherwise or clear from the context to be directed to an exclusive form. Further, the terms "a," "an," and "the" are intended to mean one or more unless specified otherwise or clear from the context to be directed to a singular form. The term "include" and its various forms are intended to mean including but not limited to. References to "one embodiment," "an embodiment," "example embodiment," "various embodiments," and other like terms indicate that the embodiments of the disclosed technology so described may include a particular function, feature, structure, or characteristic, but not every embodiment necessarily includes the particular function, feature, structure, or characteristic. Further, repeated use of the phrase "in one embodiment" does not necessarily refer to the same embodiment, although it may. The terms "substantially," "essentially," "approximately," "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. A device or structure that is "configured" in a certain way is configured in at least that way, but may also be configured in ways that are not listed.

What is claimed is:

1. A guidance system for a firearm, comprising:
at least one camera;
a high-definition flexible touch screen;
a cable connecting the camera to the touch screen;
a 3 point or 5 point hinge connected to the touch screen;
a battery; and
a processor.

2. The guidance system of claim 1, wherein the camera includes a night vision sensor and a thermal sensor.

3. The guidance system of claim 1, wherein the guidance system is mounted on a fixture configured to snap onto the firearm and not make contact with the receiver of the firearm.

4. The guidance system of claim 1, wherein the guidance system is mounted on a fixture configured to snap onto the firearm, and the frame is formed from carbon fiber or plastic.

5. The guidance system of claim 1, wherein the flexible touch screen is rotatable.

6. The guidance system of claim 1, wherein the battery comprises a 4000 mah battery pack.

7. The guidance system of claim 1, wherein the battery is rechargeable.

8. The guidance system of claim 1, further comprising a tinted screen cover.

9. The guidance system of claim 1, wherein the camera is configured to be mounted under the barrel of the firearm.

10. The guidance system of claim 1, wherein the camera is configured to be mounted on a side of the firearm.

11. The guidance system of claim 1, wherein the touchscreen is from about 3 inches to about 5 inches square or larger.

12. The guidance system of claim 1, wherein the touchscreen has zooming functionality.

13. The guidance system of claim 1, including a thermal camera.

14. The guidance system of claim 13, wherein the thermal camera is a 200× zoom thermal camera.

15. The guidance system of claim 1, wherein the guidance system is water resistant in fresh water to a maximum depth of 1.5 meters for up to 30 minutes.

16. The guidance system of claim 1, wherein the processor is configured to integrate data from the camera and a thermal sensor or a thermal camera and to project the integrated data onto the touch screen.

17. The guidance system of claim 1, wherein there is a male electrical connector directly attached to the touch screen, and the male electrical connector is configured to be attached to a female electrical connector.

18. The guidance system of claim 1, wherein there is a male electrical connector attached to the touch screen, and a gooseneck having a male electrical connector and a female electrical connector configured to be attached to the male electrical connector attached to the touch screen.

19. The guidance system of claim 18, wherein the gooseneck is a solid tube with an electrical cable running inside.

20. The guidance system of claim 18, wherein the gooseneck is a flexible coaxial cable.

* * * * *